US005953968A

United States Patent [19]

Macor

[11] Patent Number: 5,953,968

[45] **Date of Patent: *Sep. 21, 1999**

[54] SURFACE CONFORMING, TORQUE ENHANCING WRENCH WITH NON-PARALLEL WORKING SURFACES

[75] Inventor: Richard J. Macor, Township of Greenwich, County of Warren, N.J.

[73] Assignee: Proprietary Technologies, Inc., Stewartville, N.J.

[ * ] Notice: This patent is subject to a terminal disclaimer.

[21] Appl. No.: 09/080,324

[22] Filed: May 15, 1998

[51] Int. Cl.[6] ..... B25B 13/02

[52] U.S. Cl. ..... 81/119; 81/121.1; 81/124.3; 81/124.7; 81/186

[58] Field of Search ..... 81/112, 186, 121.1, 81/124.3, 124.7

[56] References Cited

U.S. PATENT DOCUMENTS 3,241,409 3/1966 Raptis .
3,242,775 3/1966 Hinkle .
3,695,124 10/1972 Myers .
3,881,377 5/1975 Evans et al. .
4,361,412 11/1982 Stolarczyk .
4,512,220 4/1985 Barnhill, III et al. .
4,598,616 7/1986 Colvin .
4,882,957 11/1989 Wright et al. .
5,131,312 7/1992 Macor ..... 81/119

*Primary Examiner*—David A. Scherbel
*Assistant Examiner*—Philip J. Hoffmann
*Attorney, Agent, or Firm*—Kenneth P. Glynn, Esq.

[57] ABSTRACT

The present invention involves a wrench for tightening and loosening bolts, nuts and fasteners having n number of equal length outside working surfaces. The wrench has a handle and a working wrench head with an orifice which contains at least two pairs of flat inside working surfaces. The pairs of inside working surfaces are arranged about and equidistant from an imaginary central axis through the orifice, and the surfaces of each pair form a surface contact angle a with one another. Additionally, each pair of flat inside working surfaces having a first working surface with a predetermined angle C relative to the imaginary central axis and a second working surface with a predetermined angle D relative to the imaginary central axis, wherein the angle C and the angle D differ from one another, and whereby the first working surface of a given pair of inside working surfaces is non-parallel to the second working surface of an opposing pair of inside working surfaces.

20 Claims, 3 Drawing Sheets

SURFACE CONFORMING, TORQUE ENHANCING WRENCH WITH NON-PARALLEL WORKING SURFACES

BACKGROUND OF THE INVENTION

1. Field of the Invention

The present invention relates to a wrench which has unique pairs of inside working surfaces which are non-parallel to one another and have been developed to reduce or eliminate slippage and other conventional wrench problems, and to provide for surface-to-surface contact instead of point-to-point contact during high torque usage. The present invention wrench may be open-end, adjustable, or otherwise.

2. Information Disclosure Statement

Various types of wrenches having conventional configurations to conform to the exact shape of nuts, bolts and fasteners with which they are used have, by necessity, tolerances and clearances which create problems when substantial torque is applied to the wrenches. Recent developments in the art have been directed to the reduction of slip and wear of fastener corners by conventional wrenches.

For example, U.S. Pat. No. 3,125,910 issued to Kavalar describes a wrench having at least 10 cylindrical lobes for equalizing torque exertion. U.S. Pat. No. 3,241,409 to Raptis describes a box wrench having a pivotally, slidably disposed torquing element for relative movement of opposite contact surfaces within the wrench opening during application of torque. This device requires substantial manufacturing with moving parts.

U.S. Pat. No. 3,242,775 to Hinkle describes a wrench for engaging nut contact surfaces to inhibit marring. Curved wrench surfaces are utilized for contact surfaces of the wrench head, and angles vary along these contact surfaces to have a first, then a second portion contact the nut sequentially with increased torquing.

U.S. Pat. No. 3,695,124 to Myers describes an angular wrench head with arcuated ribs for rounded point contact with fasteners.

U.S. Pat. No. 3,881,377 to Evans et al describes a ratcheting wrench for octagonal or hexagonal members having a body, a handle means attached to the body, a torquing jaw and a backup jaw extending from the body to receive the octagonal or hexagonal member therebetween, the backup jaw has a planar working surface and the torquing jaw having a working surface parallel to and spaced from the working surface of the backup jaw, the length of the torquing jaw working surface being less than one-half the length along a side of the octagonal member, the torquing jaw terminating at the outer end opposite the handle in an inclined slipping surface, the ratcheting wrench serving to engage the octagonal or hexagonal member in successive rotary motion without removing contact from the octagonal member.

U.S. Pat. No. 4,361,412 to Stolarczyk describes a body that is provided defining a center axis and having at least four adjacent sides equally spaced from and about the center axis and disposed normal to adjacent 60° relatively angularly displaced radii of the center axis. Each of the sides includes opposite ends and at least the center two sides of the four adjacent sides are interrupted centrally intermediate their opposite ends by a pair of spaced torque transfer surfaces spaced apart generally one-third the length of the corresponding side and equally from the opposite ends thereof. The surfaces are disposed on radii of the center axis.

In a first form of the invention only four of the adjacent sides are provided and the end two or remote sides of the four adjacent sides are free of the aforementioned transverse surfaces and the sides face inwardly toward the center axis of the body. In second and third forms of the invention, the sides equal six in number and comprise outwardly and inwardly facing sides, respectively, and each of the sides includes the side interrupting surfaces with the surfaces extending from the sides inwardly toward the center axis. Each pair of surface inner ends are interconnected by an edge extending therebetween disposed generally normal to a radius of the center axis bisecting the edge.

U.S. Pat. No. 4,512,220 to Barnhill, III et al describes a socket wrench for a hexagonal fastener wherein the clockwise and counterclockwise drive portions of the internal surface configuration of the wrench engage an associated hexagonal fastener with substantially surface to surface contact on each fastener side in close proximity to, but always spaced from, a fastener corner, thereby providing a maximum practical moment arm between wrench and fastener, and yet avoiding deteriorating engagement between the wrench and the fastener corners. The clockwise and counterclockwise drive portions of the wrench occupy the middle about ½of each uniform 60° segment of the wrench opening. The space on the internal surface configuration of the wrench between adjacent pairs of drive portions is relieved just enough to avoid interference with the corners of the fastener, thereby providing a rotational clearance of about 25° with the fastener, the precise angular amount depending on manufacturing tolerances in the wrench and fastener. This extended rotational clearance is particularly advantageous in the field of power driven socket wrenches, especially power driven socket wrenches of the multiple spindle type commonly used in manufacturing operations.

U.S. Pat. No. 4,598,616 to Colvin describes a wrench opening is disclosed as having particular utility for use with a socket or closed end wrench and includes inwardly convex engagement surfaces defining a closed shape and having continuously curved end portions that provide greater surface-to-surface engagement with a nut or bolt head to be torqued than is possible with conventional flat engagement surface portions. The curvature of the engagement surfaces is selected to provide maximum surface-to-surface engagement when normal tolerance deviations are involved. Connecting surfaces extending between the engagement surfaces are constructed to provide improved stress distribution and reduced tooling cost.

U.S. Pat. No. 4,882,957 to Wright et al describes a wrench for turning a fastener nut having a central axis and an even-numbered plurality of flat bounding surfaces parallel to the central axis with diametrically opposite pairs being parallel to each other. The wrench includes a fastener nut engaging socket defined about a central socket axis by a plurality of uniformly spaced peripherally and radially disposed protuberances and a plurality of uniformly spaced corner recesses disposed between the protuberances. Each protuberance includes side-by-side angularly related straight engaging surfaces at substantially 142° outside obtuse angles to each other for registry with the flat surfaces on the fastener nut and complementary side surfaces outwardly diverging from said engagement surfaces. Each recess is comprised of a first arcuate surface tangential to a circle about the central axis of the socket and transitional surfaces converging from the side surfaces of adjacent protuberances toward the first arcuate surface.

U.S. Pat. No. 5,131,312 to Macor describes a wrench for tightening and loosening bolts, nuts and fasteners having a number of equal length outside working surfaces. The wrench has a working wrench head with an orifice which contains at least two pairs of flat inside working surfaces. The pairs of inside working surfaces are arranged about and equidistant from an imaginary central axis through the orifice, and the surfaces of each pair form a surface contact angle A with one another. A handle which, is removably or permanently connected to the working wrench head and adapted for rotation of the working wrench head. In one preferred embodiment, two pairs of flat inside working surfaces are directly opposite one another.

Notwithstanding attempts in the prior art to overcome the substantial deficiencies of standard wrenches none of the prior art teaches or renders obvious the improved wrench of the present invention with its non-parallel, specifically defined working surfaces.

SUMMARY OF THE INVENTION

The present invention involves a wrench for tightening and loosening bolts, nuts and fasteners having n number of equal length outside working surfaces. The wrench has a handle and has a working wrench head with an orifice which contains at least two pairs of flat inside working surfaces. The angular points of the pairs of inside working surfaces are arranged about and equidistant from an imaginary central axis, at least one pair being opposite at least one other pair thereof, each such working surface of each pair forming a surface contact angle A with one another, whereby the surface contact angle A is equal to or greater than 203° and A is equal to or less than 217°, and each pair of flat inside working surfaces having a first working surface with a predetermined angle C relative to said imaginary central axis and a second working surface with a predetermined angle D relative to said imaginary central axis, wherein said angle C and said angle D differ from one another, and whereby said first working surface of a given pair of inside working surfaces is non-parallel to said second working surface of an opposing pair of inside working surfaces. In some preferred embodiments, the inside working surfaces are taken from a pattern of pairs of inside working surfaces equal to the number of outside working surfaces of a fastener to which the wrench may be applied with a specified angle B, wherein B is an angle formed by two surfaces, one each from a pair of adjacent flat contact surfaces wherein B can be determined by the formula:

$$B \geqq 140° - (360°/n) \quad (i)$$

and, $$B \leqq 160° - (360°/n) \quad (ii)$$

wherein n is the number of outside working surfaces of said fastener to which the wrench may be applied and n is at least three.

BRIEF DESCRIPTION OF THE DRAWINGS

The present invention should be more fully understood when the specification.herein is taken in conjunction with the drawings appended hereto wherein:

FIG. 5 shows the front cut view of the wrench at rest located about a bolt and FIG. 6 shows the front cut view with the wrench under torque against the bolt;

DETAILED DESCRIPTION OF THE PRESENT INVENTION

The present invention is directed to a wrench for tightening and loosening bolts, nuts and fasteners which generally have a specified number of outside working surfaces of equal length. The present invention wrench may take the form of many known wrenches, such as open-end wrenches, adjustable wrenches or the like, but has unique pairs of inside working surfaces as more fully described below. By "fasteners" is meant any object which may be rotated for tightening or loosening with a wrench of some sort.

It is an object of the present invention to provide a wrench head which eliminates the problems which are inherent with conventional wrenches. These problems arise from the fact that conventional wrenches customarily have fastener engaging orifices with planar or flat surfaces arranged in directly opposite parallel pairs which are arranged in a shape duplicating and or paralleling all or a portion of the outside working surfaces of nuts, bolts or fasteners with which they are used. Although standardized dimensions, tolerances and clearances have been adapted by the wrench manufacturers, the "free swing" resulting from the clearances coupled with some metal distortion of the wrench upon torque, result in wrench surface to fastener surface separation and only point to point contact when torque is applied. Point to point contact is inferior to surface to surface contact because point to point contact may result in damage to the corners of the nut, bolt or fastener so that the wrench may ultimately not work and slip around the head of a tightly fastened nut, bolt or fastener. Also, damage and wear will eventually occur to wrench.

Thus, the present invention is specifically directed to avoiding point to point contact for high torquing wrench usage and achieving surface to surface contact between the wrench and the nut, bolt or fastener for enhanced torque capabilities. More specifically, the present invention is directed towards the maximization and equalization of surface-to-surface contact and friction, between wrench and fastener under torque.

Figure 1:
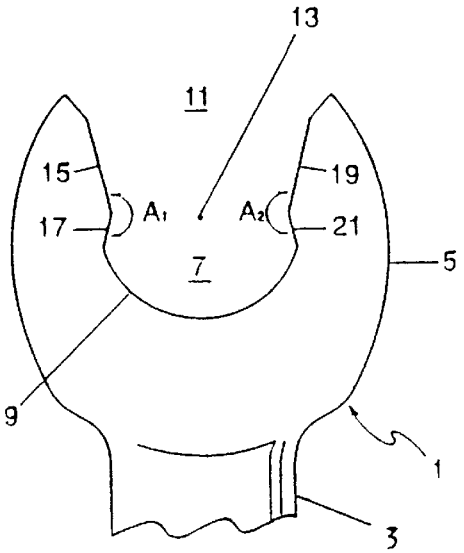
FIG. 1 PRIOR ART
FIG. 1 shows a front cut view of a Macor-type prior art open-ended wrench having two pairs of flat inside working surfaces.

Referring now to FIG. 1, there is shown a Macor prior art invention wrench 1 with handle 3, in a partial front view. Working wrench head 5 has an orifice 7 with open end 11 and imaginary central axis 13. Orifice 7 has two pairs of inside working surfaces. One pair is formed by flat inside working surfaces 15 and 17 and the other by flat inside working surfaces 19 and 21 separated by curve surface 9. Surfaces 15 and 17 form angle $A_1$ and surfaces 19 and 21 form angle $A_2$. Angles $A_1$ and $A_2$ may be the same or slightly different and are preferably the same. These angles are herein referred to as surface contact angles. Subsequently, flat inside working surfaces are also referred to as flat contact surfaces herein.

Generally, these prior art Macor wrenches, as well as the present invention wrenches, have surface contact angles A, which are equal to or greater than 200° and equal to or less than 220°. Desirably, the surface contact angle A is equal to or greater than 203° and is equal to or less than 217°. Preferably it is an angle equal to or greater than 206° and equal to or less than 214°. In the most preferred embodiments, the surface contact angle is approximately 210°.

Figure 2:
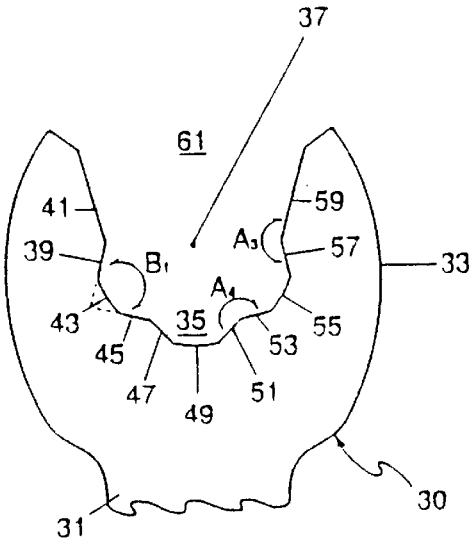
FIG. 2 PRIOR ART
FIG. 2 is a front cut view of another prior art Macor-type open-ended wrench having four pairs of flat inside working surfaces.

FIG. 2 illustrates another Macor-type prior art wrench 30 with handle 31, in a partial front view. Working wrench head 33 has an orifice 35 with open end 61 and imaginary central axis 37. Orifice 35 has four pairs of inside working surfaces. One pair is formed by flat contact surfaces 39 and 41 and adjacent thereto is arcuated surface 43, followed by a second pair of flat contact surfaces 45 and 47. Next is arcuated surface 49, followed by a third pair of flat contact surfaces 51 and 53. Surfaces 57 and 59 form the fourth pair of flat contact working surfaces and are separated from the third pair by arcuated surface 55. Examples of the surface contact angles formed are angles $A_3$ and $A_4$, each equal to approximately 209°, preferably 210°, for example. Typical of angles separating the pairs of flat contact surfaces is angle $B_1$, which separates surface 39 from surface 45 and is equal to about 89° to 91°, although angle $B_1$ will be dependent upon the locations and number of pairs, and will thus be dependent upon the number of surfaces n, upon which the wrench will be used. Also, angle $B_1$ may be calculated based on an imaginary pattern of pairs of flat contact surfaces with the number of such pairs equal to the number of outside working surfaces on a fastener to which the wrench may be applied, with the angular points of such pairs arranged about and equidistant from an imaginary central axis. Generally angle B can be determined by the following formula:

$$B \geqq 140° - (360°/n) \quad (i)$$

and are equal to or less than the angle calculated by the formula:

$$B \leqq 160° - (360°/n) \quad (ii)$$

where n is the number of outside working surfaces of bolts, nuts and fasteners for which the wrench is to function, and n is at least 3. As few as two pairs of flat contact surfaces may be taken from a pattern of pairs equal to the number of outside working surfaces of a fastener for which the wrench may be applied. Examples of these wrenches are shown in FIGS. 1,4,5,6 and 7.

In both the Macor prior art and the present invention wrenches, preferred embodiments of these wrenches have angles B calculated by the formula:

$$B \geqq 143° - (360°/n) \quad (iii)$$

and are equal to or less than the angle calculated by the formula:

$$B \leqq 157° - 360°/n) \quad (iv)$$

where n is the number of outside working surfaces of bolts, nuts and fasteners for which the wrench is to function, and n is at least 3. In the most preferred embodiments, angles B are:

$$B \geqq 146° - (360°/n) \quad (v)$$

and are equal to or less than the angle calculated by the formula:

$$B \leqq 154° - (360°/n) \quad (vi)$$

where n is the number of outside working surfaces of bolts, nuts and fasteners for which the wrench is to function, and n is at least 3.

In the case of FIG. 2, the surface contact angle between $A_3$ and $A_4$ is approximately 90°, although angle B could be any of the angles within the ranges resulting from the above formulas.

Figure 3:
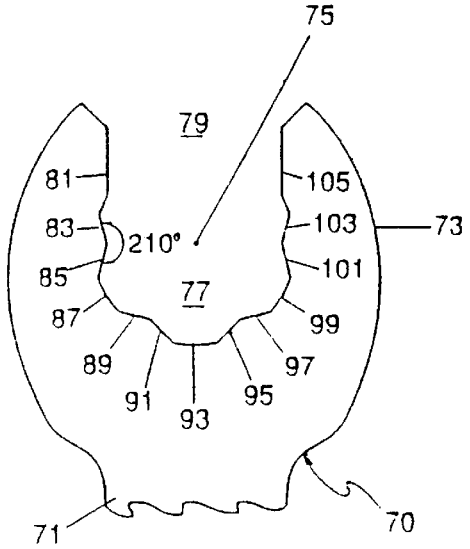
FIG.3 PRIOR ART
FIG. 3 is a front cut view of the prior art wrench shown in FIG. 2 but with a sizing feature.

FIG. 3 shows a cut front view of another prior art open end wrench 70, having handle 71 and head 73. Imaginary central axis 75 is in orifice 77 with open end 79. Four pairs of inside working surfaces 83 and 85; 89 and 91; 95 and 97; 101 and 103, are included and are separated respectively by arcuated cut outs or curved surfaces 87, 93 and 99. Angles are as shown and the surface contact angles are 210°. Included in this wrench are sizing surfaces 81 and 105 for fitting about a nut, bolt or other fastener to confirm that the user has the correct size wrench for a particular job.

Figure 4:
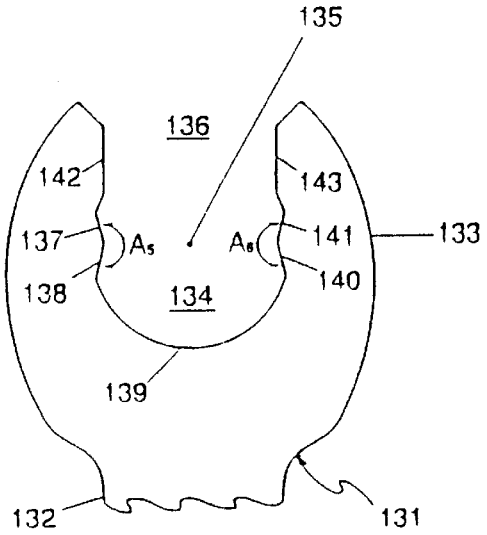
FIG. 4 PRIOR ART
FIG. 4 is another version of a Macor-type prior art wrench having two pairs of flat inside working surfaces and includes a sizing feature.

Referring now to FIG. 4, there is shown a front cut view of a Macor-type prior art wrench 131 with handle 132. Working wrench head 133 has an orifice 134 with open end 136 and imaginary central axis 135. Orifice 134 has two pairs of inside working surfaces. One pair formed by flat inside working surfaces 137 and 138 and the other by flat inside working surfaces 140 and 141. They are separated by curved surface 139, as shown. Wrench 131 also includes sizing surfaces 142 and 143, as shown.

Surfaces 137 and 138 form angle $A_5$ and surfaces 140 and 141 form angle $A_6$. Angle $A_5$ and $A_6$ may be the same or slightly different and are preferably the same. These angles are herein, surface contact angles having ranges greater than or equal to 200° but less than or equal to 220°.

The present invention incorporates the various features described relative to the Macor-type prior art wrenches described above and, as mentioned elsewhere above, the present invention also incorporates the unique feature of having pairs of flat working surfaces which are adjacent one another wherein a first working surface of the pair has a predetermined angle C and the second working surface of the pair has a predetermined angle D, where both angle C and angle D are determined relative to an imaginary central axis and where angle C and angle D differ from one another. In other words, unlike the disclosed features of the Macor prior art wrenches, there are opposite pairs of flat inside working surfaces in the present invention wrench wherein the first inside working surface of a given pair of flat inside working surfaces has an angle different from the second inside working surface of the opposing pair of inside working surfaces. This feature compensates for the predetermined wrench expansion under torque, to maximize and equalize surface-to-surface contact and friction between wrench and fastener.

For example, when the outer contact surface or first inside working surface (angle C) of a given pair of inside working surfaces has an angle less than the inner contact surface or second inside working surface (angle D) of an opposing pair of inside working surfaces, the first inside working surface initially has less friction against the fastener allowing it to slip easier on the fastener than the second inside working surface of the opposing pair of inside working surfaces. This is desirable because the wrench is then drawn in against the fastener, instead of being pulled away with a cam effect.

When the wrench stops its predetermined expansion under torque, the first inside working surface (angle C) of a given pair of inside working surfaces has increased, and the second inside working surface (angle D) of the opposing pair of inside working surfaces has decreased. (Appreciate that the first inside working surface (angle C) usually changes at a faster rate and therefore more than the second inside working surface of the opposing pair.) In any event, the objective is to reach a parallel relationship between the first inside working surface (angle C) of a given pair of working surfaces and the second inside working surface of the opposing pair of inside working surfaces (angle D) such that the only two working surfaces achieve a relatively equal amount of surface-to-surface contact and friction with fastener while under torque, and thus non-parallel when at rest.

Figure 5:
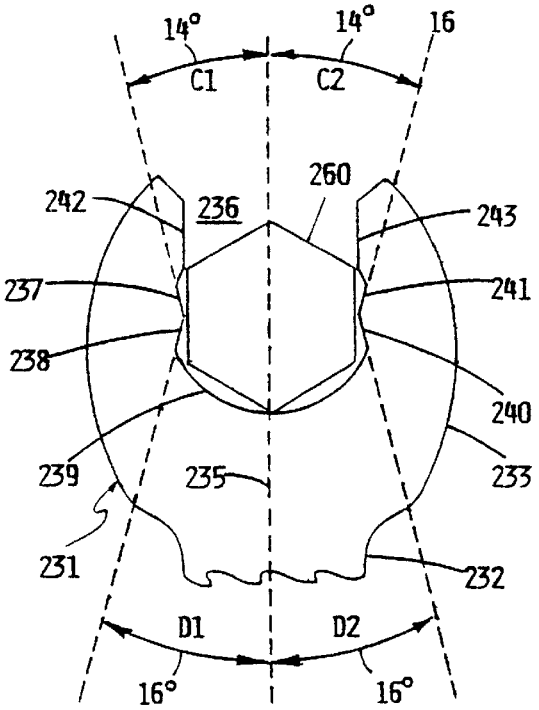
FIGS. 5 and 6 show a present invention wrench having two pairs of flat inside working surfaces and a sizing feature.

Referring now to FIG. 5, there is shown a front cut view of a present invention wrench 231 with handle 232. Hexagonal bolt 260 is the fastener which is to be tightened and illustrates the relationship between wrench 231 and (fastener) bolt 260 when present invention wrench is at rest (not under torque). Working wrench head 233 has an orifice with open end 236 and imaginary central axis 235. Wrench head 233 has two pairs of inside working surfaces. One pair is formed by flat inside working surfaces 237 and 238 and the other by flat inside working surfaces 240 and 241. They are separated by curved surface 239, and this wrench 231 includes sizing surfaces 242 and 243, as shown. Surfaces 237 and 238 form an angle similar to angle $A_5$ of FIG. 4 and surfaces 240 and 241 form an angle similar to angle $A_6$ of FIG. 4. Additionally, angle $C_1$, formed between surface 237 and imaginary central axis 235 is shown to be 14° and adjacent surface 238 forms an angle $D_1$, with imaginary central axis 235 of 16°. These angles C, and D, are, critically, different from one another. Likewise corresponding angles $C_2$ and $D_2$ are 14° and 16° respectively. While illustrated in FIG. 5 to have a 2° difference between angles C and D, these differences may be more or less. A difference of at least 0.5 degrees is desirable and at least 1.0 degree is preferable. Once this invention is disclosable, an artisan will determine optimum angle differences to suit specific wrench metal compositions. In other words, a more yielding wrench may need a 2.5° angle C–D difference, while a stronger wrench may need only a 1.0° difference between angles C and D to achieve parallel contact surfaces under torque.

Figure 6:
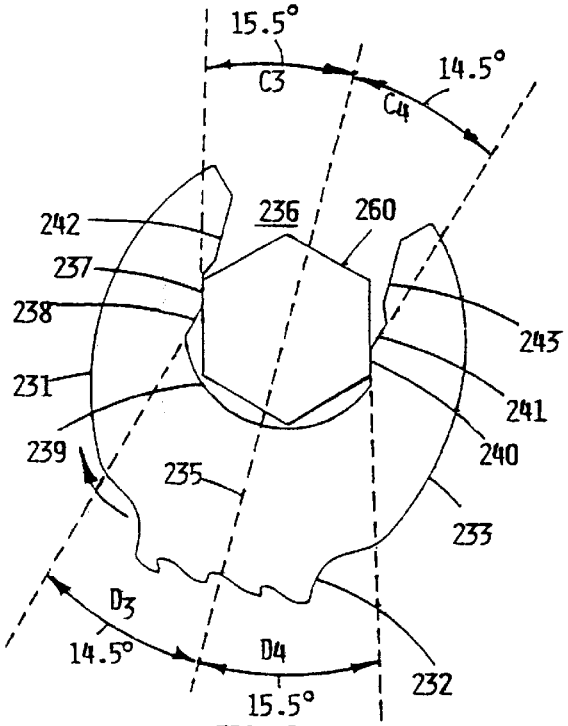

FIG. 6 illustrates present invention wrench 231 and bolt 260, shown in FIG. 5 above, but while considerable torque is being applied to bolt 260. Identical parts shown in FIG. 5 are identically numbered in FIG. 6. Note that in FIG. 5, when wrench 231 is at rest, there is only point-to-point contact, but under torque in FIG. 6, there is surface-to-surface contact between wrench 231 and bolt 260. Additionally, as a result of stress on the metal caused by the force of the torquing, the angles have changed relative to the imaginary central axis 235, and now, under torque, angles $C_4$ and $D_3$ (formerly $C_2$ and $D_1$) are both 14.5° and are equal; likewise angles $C_3$ and $D_4$ are both 15.5° and are equal. This creates a parallelism under torque which creates the very desirable surface-to-surface contact with a fastener having parallel outside contact surfaces.

Figure 7:
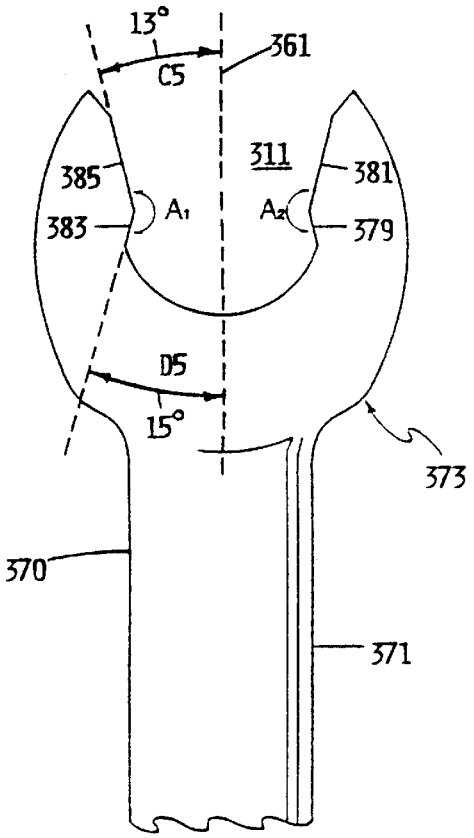
FIG. 7 shows a front cut view of a present invention open-ended wrench having two pairs of flat inside working surfaces.

Referring now to FIG. 7, there is shown a present invention wrench 370 with handle 371, in a partial front view. Working wrench head 373 has an orifice with open end 311 and imaginary central axis 361. Open end 311 has two pairs of inside working surfaces, as shown. One pair is formed by flat inside working surfaces 379 and 381 and the other by flat inside working surfaces 383 and 385. Surfaces 379 and 381 form angle $A_2$ and surfaces 383 and 385 form angle $A_1$. Angles $A_1$ and $A_2$ may be the same or slightly different and are preferably the same. These angles are the same surface contact angles for the prior art wrench shown in FIG. 1. However, note that angles $C_5$ and $D_5$ (and their corresponding vertically opposite angles) are 13° and 15° respectively, affording the ability to achieve superior surface-to-surface contact and friction with fastener, over the prior art.

Figure 8:
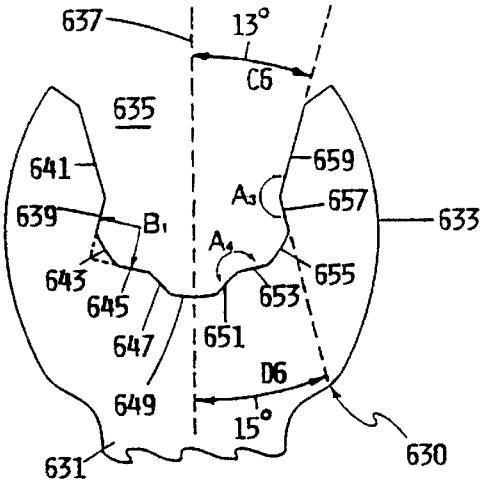
FIG. 8 is a front cut view of another present invention open-ended wrench having four pairs of flat inside working surfaces; and, FIG. 9 is a front cut view of another present invention wrench similar to the one shown in FIG. 8, but with-a sizing feature.

FIG. 8 illustrates a present invention wrench 630 with handle 631, in a partial front view. Working wrench head 633 has an orifice at open end 635 and imaginary central axis 637. Open end 635 has four pairs of inside working surfaces. One pair is formed by flat contact surfaces 639 and 641 and adjacent thereto is arcuated surface 643, followed by a second pair of flat contact surfaces 645 and 647. Next is arcuated surface 649, followed by a third pair of flat contact surfaces 651 and 653. Surfaces 657 and 659 form the fourth pair of flat contact working surfaces and are separated from the third pair by arcuated surface 655. Examples of the surface contact angles formed are angles $A_3$ and $A_4$, each equal to approximately 209°, preferably 210°, for example. Typical of angles separating the pairs of flat contact surfaces is angle $B_1$, which separates surface 639 from surface 645 and is equal to about 89° to 91°, although angle $B_1$ will be dependent upon the locations and number of pairs, and will thus be dependent upon the number of surfaces n, upon which the wrench will be used. As discussed above, angle $B_1$ may be calculated based on an imaginary pattern of pairs of flat contact surfaces with the number of such pairs equal to the number of outside working surfaces on a fastener to which the wrench may be applied, with the angular points of such pairs arranged about and equidistant from an imaginary central axis. Generally angle B can be determined by the following formula:

$$B \geqq 140° - (360°/n) \qquad (i)$$

and are equal to or less than the angle calculated by the formula:

$$B \leqq 160° - (360°/n) \qquad (ii)$$

where n is the number of outside working surfaces of bolts, nuts and fasteners for which the wrench is to function, and n is at least 3.

In the case of FIG. 8, the surface contact angle between $A_3$ and $A_4$ is approximately 90°, although angle B could be any of the angles within the ranges resulting from the above formulas. Also, and critically, angles C and D are different to achieve maximum surface-to-surface contact under torque. Here, angle $C_6$ is 13° and angle $D_6$ is 15°.

Figure 9:
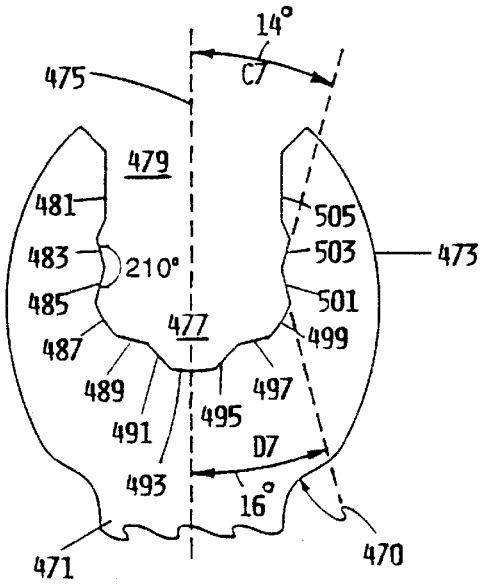

FIG. 9 shows a cut front view of present invention open end wrench 470, having handle 471 and head 473. Imaginary central axis 475 is in orifice 477 with open end 479. Four pairs of inside working surfaces 483 and 485; 489 and 491; 495 and 497; 501 and 503, are included and are separated respectively by arcuated cut outs or curved surfaces 487, 493 and 499. Angles are as shown and the surface contact angles are 210°. Included in this present invention wrench are sizing surfaces 481 and 505 for fitting about a nut, bolt or other fastener to confirm that the user has the correct size wrench for a particular job. Here, angle $C_7$ is 14° and angle $D_7$ is 16° and this will again provide for maximum surface-to-surface contact when under torque.

Obviously, numerous modifications and variations of the present invention are possible in light of the above teachings. It is therefore understood that within the scope of the appended claims, the invention may be practiced otherwise than as specifically described herein.

What is claimed is:

1. A wrench for tightening and loosening bolts, nuts and fasteners having a number of equal length outside working surfaces, which comprises:

(a) an open ended wrench head having at least two pairs of flat inside working surfaces being arranged about and equidistant from an imaginary central axis, at least one pair being opposite at least one other pair thereof, each such working surface of each pair being adjacent to one another forming a surface contact angle A with one another, whereby the surface contact angle A is equal to or greater than 203° and A is equal to or less than 217°, and each pair of flat inside working surfaces having a first working surface with a predetermined angle C relative to said imaginary central axis and a second working surface with a predetermined angle D relative to said imaginary central axis, wherein said angle C and said angle D differ from one another, and whereby said first working surface of a given pair of inside working surfaces is non-parallel to said second working surface of an opposing pair of inside working surfaces; and, (b) a handle which is connected to said working wrench head adapted for rotation of said wrench head.

2. The wrench of claim 1, wherein there are only two pairs of said flat inside working surfaces positioned opposite one another.

3. The wrench of claim 2, wherein said working wrench head is formed of two opposite pieces connected to but positionally movable relative to one another so as to form an adjustable wrench.

4. The wrench of claim 2, wherein said first working surface angle C is less than said second working surface angle D, and the difference between angle C and angle D is at least 1°.

5. The wrench of claim 2, wherein said first working surface angle C is less than said second working surface angle D, and the difference between angle C and angle D is at least 2°.

6. A wrench for tightening and loosening bolts, nuts and fasteners having a number of equal length outside working surfaces, which comprises:

(a) an open ended wrench head having at least two pairs of flat inside working surfaces being arranged about and equidistant from an imaginary central axis, at least one pair being opposite at least one other pair thereof, each such working surface of each pair being adjacent to one another forming a surface contact angle A with one another, whereby the surface contact angle A is equal to or greater than 203° and A is equal to or less than 217°, and each pair of flat inside working surfaces having a first working surface with a predetermined angle C relative to said imaginary central axis and a second working surface with a predetermined angle D relative to said imaginary central axis, wherein said angle C and said angle D differ from one another, and whereby said first working surface of a given pair of inside working surfaces is non-parallel to said second working surface of an opposing pair of inside working surfaces; and, further wherein said at least two pairs of flat inside working surfaces are taken from a pattern of pairs of flat inside working surfaces equal to the number of outside working surfaces of a fastener to which the wrench may be applied with a specified angle B, wherein B is an angle formed by two surfaces, one each from a pair of adjacent flat contact surfaces wherein B can be determined by the formula:

$$B \geqq 140° - (360°/n) \quad (i)$$

and, $$B \leqq 160° - (360°/n) \quad (ii)$$

wherein n is the number of outside working surfaces of said fastener to which the wrench may be applied and n is at least three; and, (b) a handle which is connected to said working wrench head adapted for rotation of said wrench head.

7. The wrench of claim 6, wherein there are only two pairs of said flat inside working surfaces positioned-opposite one another.

8. The wrench of claim 7, wherein said working wrench head is formed of two opposite pieces connected to but positionally movable relative to one another so as to form an adjustable wrench.

9. The wrench of claim 7, wherein said first working surface angle C is less than said second working surface angle D, and the difference between angle C and angle D is at least 1°.

10. The wrench of claim 7, wherein said first working surface angle C is less than said second working surface angle D, and the difference between angle C and angle D is at least 2°.

11. A wrench for tightening and loosening bolts, nuts and fasteners having a number of equal length outside working surfaces, which comprises:

(a) an open ended wrench head having at least two pairs of flat inside working surfaces being arranged about and equidistant from an imaginary central axis, at least one pair being opposite at least one other pair thereof, each such working surface of each pair being adjacent to one another forming a surface contact angle A with one another, whereby the surface contact angle A is equal to or greater than 206° and A is equal to or less than 214°, and each pair of flat inside working surfaces having a first working surface with a predetermined angle C relative to said imaginary central axis and a second working surface with a predetermined angle D relative to said imaginary central axis, wherein said angle C and said angle D differ from one another, and whereby said first working surface of a given pair of inside working surfaces is non-parallel to said second working surface of an opposing pair of inside working surfaces; and, (b) a handle which is connected to said working wrench head adapted for rotation of said wrench head.

12. The wrench of claim 11, wherein there are only two pairs of said flat inside working surfaces positioned opposite one another.

13. The wrench of claim 12 wherein said working wrench head is formed of two opposite pieces connected to but positionally movable relative to one another so as to form an adjustable wrench.

14. The wrench of claim 12 wherein said first working surface angle C is less than said second working surface angle D, and the difference between angle C and angle D is at least 1°.

15. The wrench of claim 12, wherein said first working surface angle C is less than said second working surface angle D, and the difference between angle C and angle D is at least 2°.

16. A wrench for tightening and loosening bolts, nuts and fasteners having a number of equal length outside working surfaces, which comprises:

(a) an open ended wrench head having at least two pairs of flat inside working surfaces being arranged about an imaginary central axis, at least one pair being opposite at least one other pair thereof, each such working surface of each pair being adjacent to one another forming a surface contact angle A with one another, whereby the surface contact angle A is equal to or greater than 206° and A is equal to or less than 214°, and each pair of flat inside working surfaces having a first working surface with a predetermined angle C relative to said imaginary central axis and a second working surface with a predetermined angle D relative to said imaginary central axis, wherein said angle C and said angle D differ from one another, and whereby said first working surface of a given pair of inside working surfaces is non-parallel to said second working surface of an opposing pair of inside working surfaces; and, further wherein said at least two pairs of flat inside working surfaces are taken from a pattern of pairs of flat inside working surfaces equal to the number of outside working surfaces of a fastener to which the wrench may be applied with a specified angle B, wherein B is an angle formed by two surfaces, one each from a pair of adjacent flat contact surfaces wherein B can be determined by the formula:

$$B \geqq 143° - (360°/n) \quad (i)$$

and, $$B \leqq 157° - (360°/n) \quad (ii)$$

wherein n is the number of outside working surfaces of said fastener to which the wrench may be applied and n is at least three; and, (b) a handle which is connected to said working wrench head adapted for rotation of said wrench head.

17. The wrench of claim 16 wherein there are only two pairs of said flat inside working surfaces positioned opposite one another.

18. The wrench of claim 17 wherein said working wrench head is formed of two opposite pieces connected to but positionally movable relative to one another so as to form an adjustable wrench.

19. The wrench of claim 17 wherein said first working surface angle C is less than said second working surface angle D, and the difference between angle C and angle D is at least 1°.

20. The wrench of claim 17 wherein said first working surface angle C is less than said second working surface angle D, and the difference between angle C and angle D is at least 2°.

* * * * *